US005114280A

United States Patent [19]

Ushitora et al.

[11] Patent Number: 5,114,280

[45] Date of Patent: May 19, 1992

[54] VACUUM TYPE SEWAGE COLLECTING SYSTEM AND VACUUM VALVE CONTROLLER FOR THE SAME

[75] Inventors: Akihiro Ushitora, Kanagawa; Kazuo Yamaguchi, Tokyo; Tsuneo Asanagi, Kanagawa, all of Japan

[73] Assignee: Ebara Corporation, Tokyo, Japan

[21] Appl. No.: 574,196

[22] Filed: Aug. 29, 1990

[30] Foreign Application Priority Data

Aug. 31, 1989 [JP] Japan ..... 1-225838

[51] Int. Cl.[5] ..... B65G 53/66

[52] U.S. Cl. ..... 406/18; 406/22; 406/23; 406/30; 406/32; 406/192; 137/236.1

[58] Field of Search ..... 406/29, 31, 32, 192, 406/18, 22, 23, 30; 137/236.1; 251/29, 48

[56] References Cited

U.S. PATENT DOCUMENTS 4,373,838 2/1983 Foreman et al. ..... 406/14

*Primary Examiner*—Margaret A. Focarino
*Assistant Examiner*—Andrew C. Pike
*Attorney, Agent, or Firm*—Wenderoth, Lind & Ponack

[57] ABSTRACT

A vacuum type sewage collecting system, for collecting sewage from a plurality of houses or the like, stores sewage in a sewage reservoir and then delivers the sewage to a sewage treatment station through a vacuum valve and a vacuum sewage pipe. A controller is provided for properly controlling opening/closing operations of the vacuum valve. The controller includes a first vacuum chamber connected to the vacuum sewage pipe via a fluid flow resisting device, a second vacuum chamber likewise connected to the vacuum sewage pipe, an atmospheric pressure introducing unit for introducing an atmospheric pressure into the first vacuum chamber when a detected quantity of sewage stored in the sewage reservoir exceeds a predetermined value, and a shifting unit for selectively introducing negative pressure to the vacuum valve to open or close the latter depending on the present differential pressure between the first vacuum chamber and the second vacuum chamber. A first opening/closing valve is disposed in a parallel relationship relative to the fluid flow resisting device such that the first opening/closing valve is closed when the negative pressure in the vacuum sewage pipe is lower than a preset value. Alternatively, a closed type air tank is connected to the first vacuum chamber via a second opening/closing valve such that the second opening/closing valve is opened when the negative pressure in the vacuum sewage pipe is lower than the preset value.

4 Claims, 5 Drawing Sheets

VACUUM TYPE SEWAGE COLLECTING SYSTEM AND VACUUM VALVE CONTROLLER FOR THE SAME

BACKGROUND OF THE INVENTION

1. Field of the Invention

The present invention generally relates to a sewage collecting system. More particularly, the present invention relates to a vacuum type sewage collecting system for collecting sewage from a number of houses. In addition, the present invention relates to a controller for properly controlling opening/closing operations of a vacuum valve employable in the vacuum type sewage collecting system.

2. Description of the Related Art

A vacuum type sewage collecting system has been heretofore known for collecting sewage from a number of houses.

FIG. 3 is a schematic perspective view which shows the entire structure of a vacuum type sewage collecting system of the foregoing type.

As shown in the drawing, sewage discharged from houses 130 on the ground flows via a plurality of natural flow-down type sewer pipes 101 into a sewage reservoir 3 disposed underground. The sewage reservoir 3 has a vacuum valve 1 included therein. When a predetermined quantity of sewage has been collected in the sewage reservoir 3, it is sucked into a vacuum sewage pipe 110 via a suction pipe 5 and the vacuum valve 1, so as to be collected in a collecting tank 41 of a vacuum pump station 40. A constant level of vacuum in the collecting tank 41 is maintained by a pair of vacuum pumps 43. When a predetermined quantity of sewage has collected in the collecting tank 41, the sewage is further transferred to a sewer treating station or a like installation (not shown) by a pair of pumps 42.

FIG. 4 is a sectional view of the sewage reservoir 3 having the vacuum valve 1 therein.

As is apparent from the drawing, a controller 6 is mounted on the vacuum valve 1 to properly control opening/closing operations of the vacuum valve 1.

When a quantity of sewage in excess of a predetermined amount stored in a sewage reservoir 17 is detected by a sensor tube 4, a valve disc (not shown) is opened in the vacuum valve 1. In response to this detection, a suction pipe 5 is communicated with a vacuum sewage pipe 110 so that the sewage stored in the sewage reservoir 17 is sucked up into the suction pipe 5 under the influence of a vacuum which prevails throughout the vacuum sewage pipe 110.

Next, the structure and operation of the conventional vacuum valve controller 6 will be described below.

FIG. 5 is a sectional view which schematically illustrates an inner structure of the vacuum valve controller 6 as well as the vacuum valve 1. The structure of the conventional vacuum valve controller 6 is disclosed in U.S. Pat. No. 4,373,838.

The vacuum sewage pipe 110 is connected to a distributing chamber 61 via piping 62. Negative pressure outlet piping 63 is connected to a cylinder chamber la of the vacuum valve 1. A gas pressure introducing pipe 16 is connected to the sensor tube 4 shown in FIG. 4. An atmospheric pressure introducing hole 64 communicates with the outside environment via piping 65.

While the illustrated state (i.e., the state wherein a quantity of sewage less than a predetermined amount is stored in the sewage reservoir 17) is maintained, the negative pressure in the vacuum sewage pipe 110, which has been introduced into the controller 6 via the pipe 62, is delivered to a first vacuum chamber 70, piping 68 and a needle valve 69. A valve port 67 of the first vacuum chamber 70 is normally closed by a valve 66. In addition, the negative pressure is also delivered to a second vacuum chamber 73 via the piping 68, an orifice 71, and piping 72.

At this time, the interior of the first vacuum chamber 70 and the interior of the second vacuum chamber 73 are held at the same negative pressure, respectively, and a valve stem 76 having a diaphragm 75 fixedly secured thereto is displaced to an ultimate position on the left-hand side by a coil spring 74.

Further, the atmospheric pressure which has been introduced into the controller 6 via the piping 65 is delivered to a cylinder chamber 1*a* of the vacuum valve 1 via piping 63. A valve disc 1*c* fixedly secured to a piston 1*b* is brought into contact with a valve seat 1*e* under the atmospheric pressure and the resilient force of a coil spring 1*d*, whereby communication between the vacuum sewage pipe 110 and the suction pipe 5 is interrupted.

As an increasing amount of sewage is stored in the sewage reservoir 17 (see FIG. 4) and the depth of the stored sewage increases, the gas pressure in the sensor tube 4 correspondingly increases. This causes the pressure in a pressure detecting chamber 77, communicated with the sensor tube 4, to increase, whereby a diaphragm 78 defining the pressure detecting chamber 77 is displaced in the rightward direction as viewed in FIG. 5.

At this time, a projection 79 on the diaphragm 78 is likewise displaced in the rightward direction until it comes into contact with one end of a lever 80 and is thrust against the latter.

Then, the lever 80 turns about a hinge 81 in a clockwise direction so that a valve 82 on the other end of the lever 80 opens a valve port 83.

When the valve port 83 is opened, the atmospheric pressure in an atmospheric pressure chamber 85 communicated with the piping 65, the atmospheric pressure introducing hole 64, and a passage 84, is introduced into the first vacuum chamber 70.

As a result, a differential pressure is established between the second vacuum chamber 73 held in the negative pressure state and the first vacuum chamber 70 held in the atmospheric pressure state, whereby a diaphragm 75 is displaced against the resilient force of the coil spring 74 in the rightward direction. Thus, the valve stem 76 fixedly secured to the diaphragm 75 is displaced in the rightward direction so that the valve 66 interrupts the communication between the atmospheric pressure hole 64 and the piping 63 and simultaneously establishes the communication between the distributing chamber 61 and the piping 63.

For this reason, the negative pressure in the vacuum sewage pipe 110 is introduced into the cylinder chamber 1*a* of the vacuum valve 1 via the piping 62, the distributing chamber 61, the valve port 67, and the piping 63. This causes the piston 1*b* and the valve disc 1*c* to be raised up against the resilient force of the coil spring 1*d*, whereby the suction pipe 5 is communicated with the vacuum sewage pipe 110.

Then, the sewage stored in the sewage reservoir 17 shown in FIG. 4 is sucked into the vacuum sewage pipe 110 via the suction pipe 5.

As shown in FIG. 5, the piping 62 is connected to the vacuum sewage pipe 110 at a location in the vicinity of the vacuum valve 1. Therefore, when the suction pipe 5 is communicated with the vacuum sewage pipe 110, there is a possibility that the pressure prevailing in the connection region will be raised to a level near the atmospheric pressure. To avoid the foregoing possibility, a check valve 199 is disposed in the piping 62 and a check valve 86 is additionally disposed in the piping 68. Therefore, air having a pressure near to atmospheric pressure is never introduced into the first vacuum chamber 70 and the second vacuum chamber 73.

Next, as the quantity of sewage in the sewage reservoir 17 decreases, the gas pressure in the sensor tube 4 and the pressure detecting chamber 77 decreases and the differential pressure between the pressure detecting chamber 77 and the atmospheric pressure chamber 85 decreases. Then, the diaphragm 78 is restored to its original position, whereby the lever 80 is released from the thrusting state induced by the projection 79, and the valve port 83 is closed with the valve 82.

Thereafter, air in the first vacuum chamber 70 held at the atmospheric pressure is gradually displaced to the second vacuum chamber 73 via the piping 68, the needle valve 69, an orifice 71, and piping 72, while it is likewise gradually displaced to the distributing chamber 61 via check valve 86.

As the differential pressure between the first vacuum chamber 70 and the second vacuum chamber 73 gradually disappears, the diaphragm 75 is gradually restored to its original state. Thus, owing in part to the resilient force of coil spring 74, the valve stem 76 is restored to its original position at which the valve port 67 is closed with the valve 66.

When the atmospheric pressure introducing hole 64 is communicated with the piping 63, the atmospheric pressure is introduced into the cylinder chamber 1*a* so that the negative pressure which has raised the piston 1*b* disappears. As a result, the valve disc 1*c* is closed under the resilient force of the coil spring 1*d*.

It should be noted that the vacuum valve 1 is kept open for a predetermined period of time without the valve stem 76 being restored to the original position due to the differential pressure between the first vacuum chamber 70 and the second vacuum chamber 73, i.e. during the time when the gas pressure in the sensor tube 4 and the pressure detecting chamber 77 is reduced and the valve port 83 is closed with the valve. This is intended to additionally suck air into the sewage reservoir 17 after sewage water is sucked through the suction pipe 5, because suction of the air in this way causes the sewage and the air to be mixed together in the vacuum sewage pipe 110 in a slag flow state or a plug flow state, resulting in an increased efficiency of transportation of the sewage.

To properly adjust a period of time that elapses until the vacuum valve 1 is closed, i.e. to properly adjust a volume of air to be sucked into the vacuum sewage pipe 110, it is required that the opening of the needle valve 69 is adequately selected to establish an appropriate displacement of the gas from the first vacuum chamber 70 to the second vacuum chamber 73.

With the conventional vacuum valve controller 6 as constructed in the above-described manner, since the piping 62 is connected to a joint on the vacuum sewage pipe 110 in the vicinity of the vacuum valve 1, the negative pressure in the joint region is reduced (to a level approximately equal to the atmospheric pressure) and a negative pressure to be fed to the vacuum valve controller 1 is unavoidably reduced in a case where the vacuum sewage pipe 110 is long or an air lock occurs at an intermediate part of the vacuum sewage pipe 110.

For this reason, when the valve port 83 of the vacuum valve controller 6 is opened, causing the pressure in the first vacuum chamber 70 to be equalized to the atmospheric pressure, the differential pressure between the first vacuum chamber 70 and the second vacuum chamber 73 becomes small, since the second vacuum chamber 73 has a low negative pressure. Therefore, the diaphragm 75 is restored to its original state merely by the displacement of a small volume of air from the first vacuum chamber 70 to the second vacuum chamber 73 with the result that the vacuum valve 1 is closed within a period of time shorter than that in the normal case.

Specifically, when the negative pressure in the vacuum sewage pipe 110 is reduced for some reason, the vacuum valve 1 is closed earlier than in the normal case, whereby a small volume of air is sucked into the vacuum sewage pipe 110 and a ratio of gas to liquid in the vacuum sewage pipe 110 becomes small, resulting in a predisposition to the formation of air locks. Consequently, there repeatedly occurs a malfunction in that the negative pressure in the vacuum sewage pipe 10 is gradually reduced more and more and a volume of air to be sucked into the vacuum sewage pipe 110 gradually becomes less.

SUMMARY OF THE INVENTION

An object of the present invention is to provide a vacuum type sewage collecting system which assures that the period of time required for closing a vacuum valve can be properly controlled so as to prevent a volume of air to be sucked into a vacuum sewage pipe to be reduced, even when a negative pressure to be introduced into a vacuum valve controller from the vacuum sewage pipe is lowered.

Another object of the present invention is to provide a controller which can properly control opening/closing operations of a vacuum valve employable in a vacuum type sewage collecting system.

To accomplish the above objects, there is provided according to a first aspect of the present invention a vacuum type sewage collecting system for collecting sewage from a plurality of houses or like facilities by storing the sewage in a sewage reservoir and then delivering the sewage in the sewage reservoir to a predetermined location such as a sewage treatment station or a like installation through a vacuum valve and a vacuum sewage pipe the interior of which is held at a negative pressure, said system comprising a controller for properly controlling opening/closing operations of the vacuum valve, the controller including a first vacuum chamber, a second vacuum chamber, piping by way of which the first vacuum chamber and the second vacuum chamber are connected to the vacuum sewage pipe, a fluid flow resisting means disposed in another pipe connected to the first vacuum chamber, atmospheric pressure introducing means for introducing an atmospheric pressure into the first vacuum chamber when a detected quantity of the sewage stored in the sewage reservoir exceeds a predetermined value, and shifting means for selectively introducing negative pressure to the vacuum valve to open or close the latter depending on the present differential pressure between the first vacuum chamber and the second vacuum chamber, wherein at least one pipe having another fluid flow resisting means disposed therein is connected to the pipe having the first-mentioned fluid flow resisting means disposed therein in a parallel relationship and wherein the one pipe is provided with an opening/closing valve adapted to shut the one pipe when negative pressure in the vacuum sewage pipe is lower than a preset value.

According to a second aspect of the present invention, there is provided a vacuum sewage collecting system for collecting sewage from a plurality of houses or like facilities by storing said sewage in a sewage reservoir and then delivering the sewage stored in the sewage reservoir to a predetermined location such as a sewage treatment station or a like installation through a vacuum valve and a vacuum sewage pipe the interior of which is held at a negative pressure said system comprising a controller for properly controlling opening/-closing operations of the vacuum valve, the controller including a first vacuum chamber, a second vacuum chamber, piping by way of which the first vacuum chamber and the second vacuum chamber are connected to the vacuum sewage pipe, fluid flow resisting means disposed in another pipe connected to the first vacuum chamber, atmospheric pressure introducing means for introducing an atmospheric pressure into the first vacuum chamber when a detected quantity of the sewage stored in the sewage reservoir exceeds a predetermined value, and shifting means for selectively introducing a negative pressure to the vacuum valve to open or close the latter depending on the present differential pressure between the first vacuum chamber and the second vacuum chamber, wherein a closed type air tank having a predetermined capacity is connected to the first vacuum chamber via an opening/closing valve operatively associated with the controller for properly controlling opening/closing operations of the vacuum valve and wherein the opening/closing valve serves to interrupt the communication between the first vacuum chamber and the air tank when the negative pressure in the vacuum sewage pipe is higher than a predetermined value and to establish the communication between the first vacuum chamber and the air tank when the negative pressure in the vacuum sewage pipe is lower than the predetermined value.

In addition, according to a third aspect of the present invention, there is provided a controller for properly controlling opening/closing operations of a vacuum valve, employable in a vacuum type sewage collecting system for collecting sewage from a plurality of houses or like facilities by storing the sewage in a sewage reservoir and then delivering the sewage stored in the sewage reservoir to a predetermined location such as a sewage treatment station or a like installation through a vacuum sewage pipe the interior of which is held at a negative pressure, the controller comprising a first vacuum chamber, a second vacuum chamber, piping by way of which the first vacuum chamber and the second vacuum chamber are adapted to be connected to the vacuum sewage reservoir, fluid flow resisting means disposed in another piping connected to the first vacuum chamber, atmospheric pressure introducing means capable of introducing an atmospheric pressure into the first vacuum chamber when a detected quantity of the sewage stored in the sewage reservoir exceeds a predetermined value, and shifting means for selectively introducing negative pressure to the vacuum valve to open or close the latter depending the present differential pressure between the first vacuum chamber and the second vacuum chamber, wherein at least one pipe having another fluid flow resisting means disposed therein is connected to the pipe having the first-mentioned fluid flow resisting means disposed therein in a parallel relationship and wherein the one pipe is provided with an opening/closing valve adapted to shut the one pipe when the negative pressure in the vacuum sewage pipe is lower than a preset value.

Moreover, according to a fourth aspect of the present invention, there is provided a controller for properly controlling opening/closing operations of a vacuum valve, employable in a vacuum type sewage collecting system for collecting sewage from a plurality of houses or like facilities by storing the sewage in a sewage reservoir and then delivering the sewage stored in the sewage reservoir to a predetermined location such as a sewage treatment station or a like installation through a vacuum valve and a vacuum sewage pipe the interior of which is held at a negative pressure, the controller comprising a first vacuum chamber, a second vacuum chamber, piping by way of which the first vacuum chamber and the second vacuum chamber are adapted to be connected to the vacuum sewage pipe, fluid flow resisting means disposed in another piping connected to the first vacuum chamber, atmospheric pressure introducing means capable of introducing an atmospheric pressure into the first vacuum chamber when a detected quantity of the sewage stored in the sewage reservoir exceeds a predetermined value, and shifting means for selectively introducing a negative pressure to the vacuum valve to open or close the latter depending on the present differential pressure between the first vacuum chamber and the second vacuum chamber, wherein a closed type air tank having a predetermined capacity is connected to the first vacuum chamber via an opening/-closing valve and wherein the opening/closing valve serves to interrupt the communication between the first vacuum chamber and the air tank when the negative pressure in the vacuum sewage pipe is higher than a predetermined value and establish the communication between the first vacuum chamber and the air tank when the negative pressure in the vacuum sewage pipe is lower than the predetermined value.

As is apparent from the above description, according to the first and third aspects of the present invention, as long as the vacuum sewage pipe has a high negative pressure (i.e., it has a normal negative pressure), the opening/closing valve is kept opened. Thus, air is displaced from the first vacuum chamber to the second vacuum chamber through two or more needle valves disposed in a parallel relationship relative to each other, whereby resistance against the air flow is kept low. Consequently, the vacuum valve is closed quickly.

To the contrary, when the vacuum sewage pipe has a low negative pressure (i.e., it has a negative pressure close to atmospheric pressure and higher than the normal negative pressure), the opening/closing valve is kept closed. Thus, air flows from the first vacuum chamber to the second vacuum chamber side through only a single needle valve whereby resistance against the air flow is high. Consequently, the vacuum valve is closed after a delay despite the small differential pressure between the first vacuum chamber and the second vacuum chamber.

Therefore, even in a case where the degree of a vacuum in the vacuum sewage pipe is low, an ample volume of air can be sucked into the vacuum sewage pipe by appropriately selecting the resistance offered by the needle valves against an air flow, and which needle valves are arranged in parallel.

Further, according to the second and fourth aspects of the present invention, as long as the vacuum sewage pipe has a high negative pressure (i.e., it has a normal negative pressure), the opening/closing valve is kept closed. Thus, air in the first vacuum chamber alone is displaced to the second vacuum chamber through the needle valves. Consequently, the vacuum valve is closed quickly.

To the contrary, as long as the vacuum sewage pipe has a flow negative pressure, the opening/closing valve is kept opened. Thus, since the first vacuum chamber is communicated with the air tank, air in the first vacuum chamber and the air tank is displaced to the second vacuum chamber through a needle valve. Consequently, the vacuum valve is closed under a delay despite the small differential pressure between the first vacuum chamber and the second vacuum chamber.

Therefore, even in a case where a level of vacuum in the vacuum sewage pipe is low, an ample volume of air can be sucked into the vacuum sewage pipe.

Other objects, features and advantages of the present invention will become readily apparent from the following description which has been made in conjunction with the accompanying drawings.

BRIEF DESCRIPTION OF THE DRAWINGS

The present invention is illustrated in the following drawings in which.

DETAILED DESCRIPTION OF THE PREFERRED EMBODIMENTS

Now, the present invention will be described in detail hereinafter with reference to the accompanying drawings which illustrate preferred embodiments thereof.

It should be noted that in the following description the expression"—having a negative pressure greater than a predetermined negative pressure" means "—having an atmospheric pressure lower than a predetermined negative pressure" and the expression "—having a negative pressure lower than a predetermined negative pressure" means "—having an atmospheric pressure greater than a predetermined negative pressure".

Figure 1:
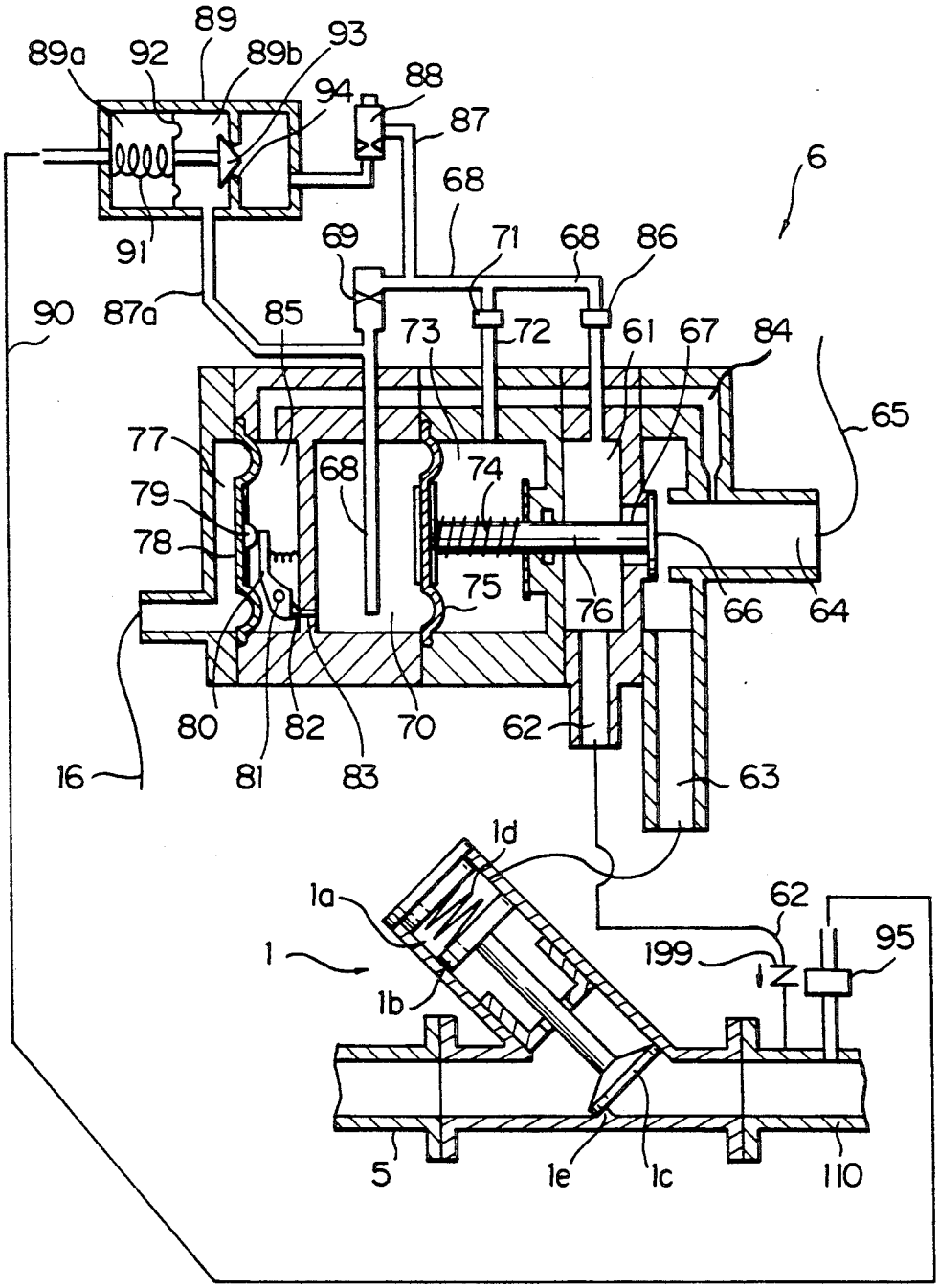
FIG. 1 is a schematic sectional view of a controller for controlling opening/closing operations of a vacuum valve, employable in a vacuum type sewage collecting system, in accordance with a first embodiment of the present invention.

FIG. 1 shows a controller for properly controlling opening/closing operations of a vacuum valve, employable in a vacuum type sewage collecting system, in accordance with a first embodiment of the present invention.

As is apparent from the drawing, in contrast with the conventional vacuum valve controller 6 which has been described above with reference to FIG. 5, a vacuum valve controller 6 of the present invention comprises a needle valve 88, a needle valve 69 arranged parallel to needle valve 88 with piping 87 extending therebetween, and an opening/closing valve 89 mounted at an intermediate location of the piping 87.

One end of piping 90 is connected to the valve 89, while the other end of the piping 90 is connected to the vacuum sewage pipe 110 in the vicinity of a joint at which piping 62 is connected to the vacuum sewage pipe 110. In FIG. 1, reference numeral 95 designates an orifice.

First, a case where a high negative pressure prevails throughout the vacuum sewage pipe 110 will be described.

In the illustrated case, i.e. in a case where a vacuum valve 1 is kept closed, a negative pressure in a first vacuum chamber 70 is equal to a negative pressure in a second vacuum chamber 73. At this time, a negative pressure in a chamber 89*a* connected to the vacuum sewage pipe 110 via the piping 90 is substantially equal to a negative pressure in a chamber 89*b* connected to the first vacuum chamber 70 via piping 87*a*. For this reason, a diaphragm 92 and a valve disc 93 attached to the diaphragm 92 are biased in the rightward direction by a coil spring 91, whereby a valve hole 94 is closed.

Next, as a quantity of sewage stored in a sewage reservoir 17 increases and the pressure in a sensor tube 4 increases correspondingly, causing a valve port 83 to be opened, the pressure in the first vacuum chamber 70 is equalized to the atmospheric pressure. Thus, a valve 66 is displaced in the rightward direction to open a valve port 67, whereby negative pressure is introduced to a cylinder chamber 1*a* to open the vacuum valve 1.

At this time, pressure in the chamber 89*b* of the valve 89 communicated with the first vacuum chamber 70 via the piping 87*a* is equalized to the atmospheric pressure. Thus, a large differential pressure arises between the chamber 89*b* and the chamber 89*a* having a high negative pressure so that the diaphragm 92 is biased in the leftward direction to open the valve hole 94.

Consequently, the piping 87*a* is opened to the needle valve 88 via valve 89. Because the needle valve 69 is connected in parallel to the needle valve 88, air in the first vacuum chamber 70 is thus displaced into the second vacuum chamber 73 and a distributing chamber 61 via the piping 68 and 87.

Since air is displaced via both piping 68 and piping 87 in the above-described manner, the period of time required for the displacement of the air is shorter compared with a case where air is displaced via the piping 68 alone.

When the differential pressure between the first vacuum valve 70 and the second vacuum pressure 73 is reduced below a predetermined value, the valve 66 is displaced in the leftward direction to close the valve port 67. Then the atmospheric pressure is introduced into the cylinder chamber 1*a* to close the vacuum valve 1.

Next, a case where a low negative pressure prevails throughout the vacuum sewage pipe 110 will be described.

As long as the vacuum valve 1 is kept closed, a negative pressure in the first vacuum chamber 70 is maintained equal to a negative pressure in the second vacuum chamber 73 via the piping 62 in the same manner as mentioned above. At this time, since the negative pressure in the chamber 89*a* connected to the sewage pipe 110 via the piping 90 is substantially equal to the negative pressure in the chamber 89*b* connected to the first vacuum chamber 70 via the piping 87*a*, the diaphragm 92 and the valve disc 93 attached to the diaphragm 92 are biased in the rightward direction by the coil spring 91 to close the valve hole 94. It should be noted that at this time, the negative pressure in the first vacuum chamber 70, the negative pressure in the second vacuum chamber 73, the negative pressure in the chamber 89*a*, and the negative pressure in the chamber 89*b* are each low, like the negative pressure in the vacuum sewage pipe 110.

Next, as a quantity of sewage stored in the sewage reservoir 17 increases whereby pressure in the sensor tube 4 increases correspondingly, the valve port 83 is opened and the negative pressure in the first vacuum chamber 70 is raised to atmospheric pressure. Then, the valve 66 is displaced in the rightward direction to open the valve port 67 whereby the pressure in the cylinder chamber la becomes negative and the vacuum valve 1 is opened.

At this time, the pressure in the valve 89 communicated with the first vacuum chamber 70 is raised to an atmospheric pressure but the negative pressure in the chamber 89*a* is low, whereby the differential pressure between the chamber 89*a* and the chamber 89*b* is at a low level. For this reason, the diaphragm 92 is not displaced under the resilient force of the coil spring 91 and the valve hole 94 remains closed.

This causes air in the first vacuum chamber 70 to be displaced into the second vacuum chamber 73 and the distributing chamber 61 via the piping 68, and the needle valve 69 which is disposed at an intermediate location in the piping 68. Thus, the period of time required for the displacement of the air flow is longer compared with a case where the vacuum sewage pipe 110 has a high negative pressure. Consequently, a period of time that elapses until the vacuum valve 1 is closed can be delayed to the same extent as in the aforementioned case where the vacuum sewage pipe 110 has a high negative pressure.

Figure 2:
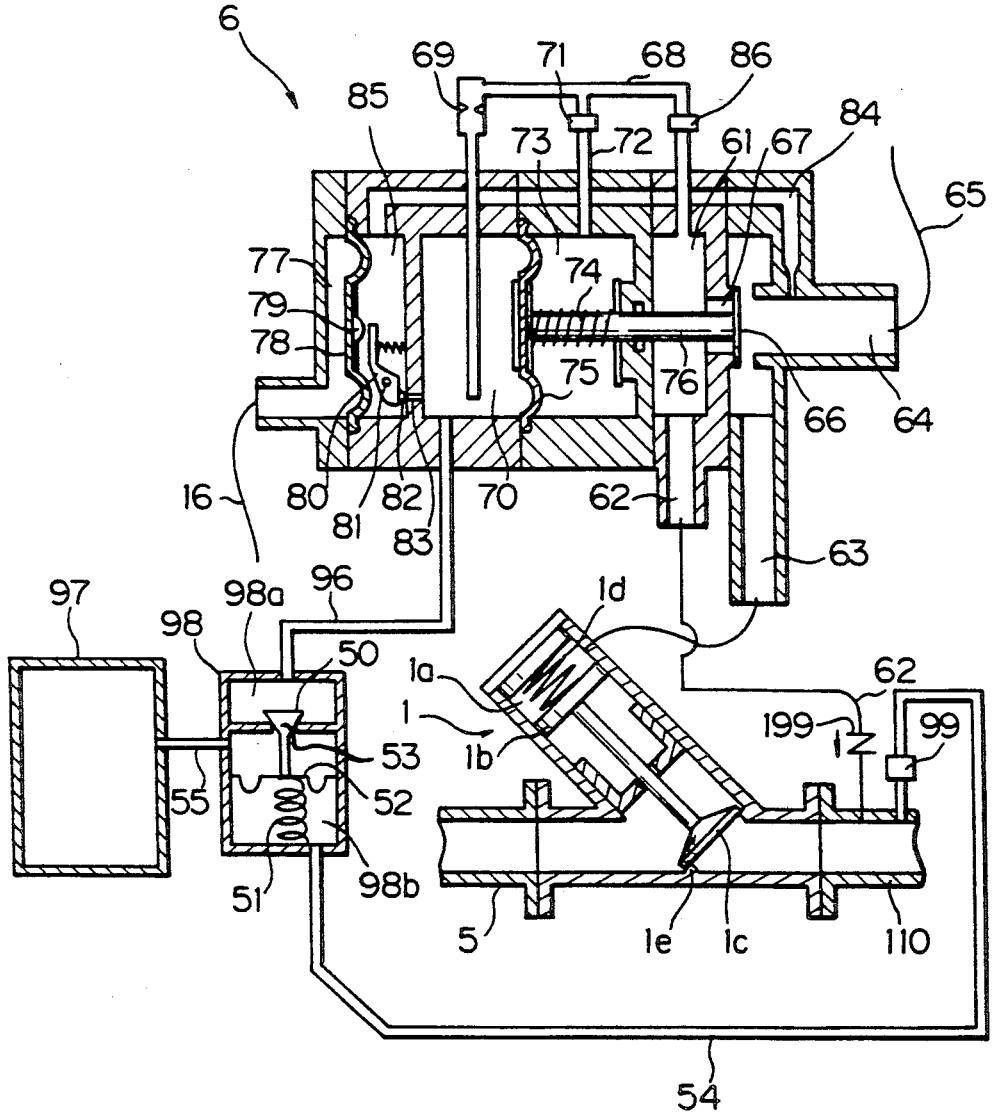
FIG. 2 is a schematic sectional view of a controller for controlling opening/closing operations of a vacuum valve, employable in a vacuum type sewage collecting system, in accordance with a second embodiment of the present invention.
Figure 3:
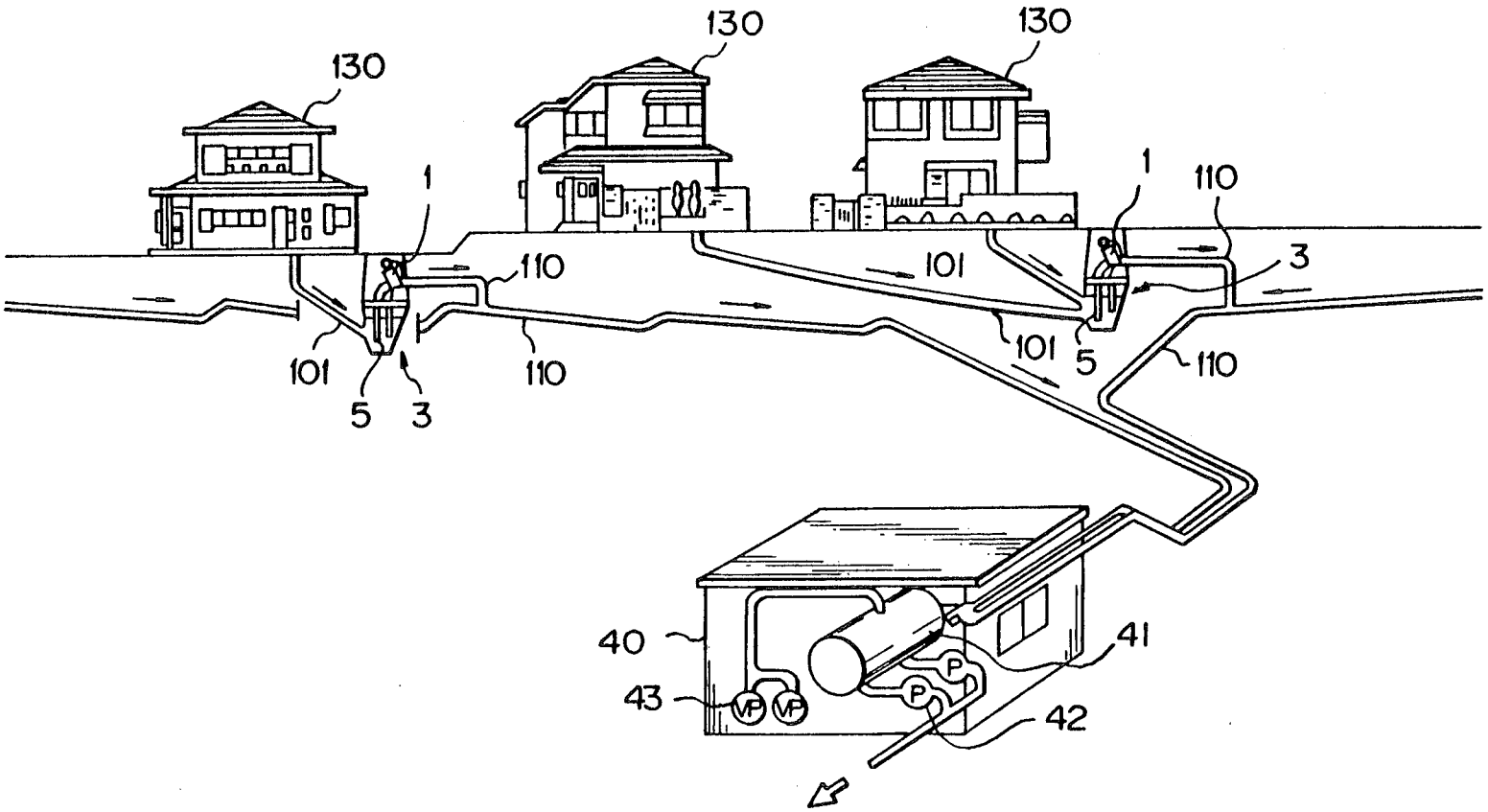
FIG. 3 is a schematic view of the vacuum type sewage collecting system.
Figure 4:
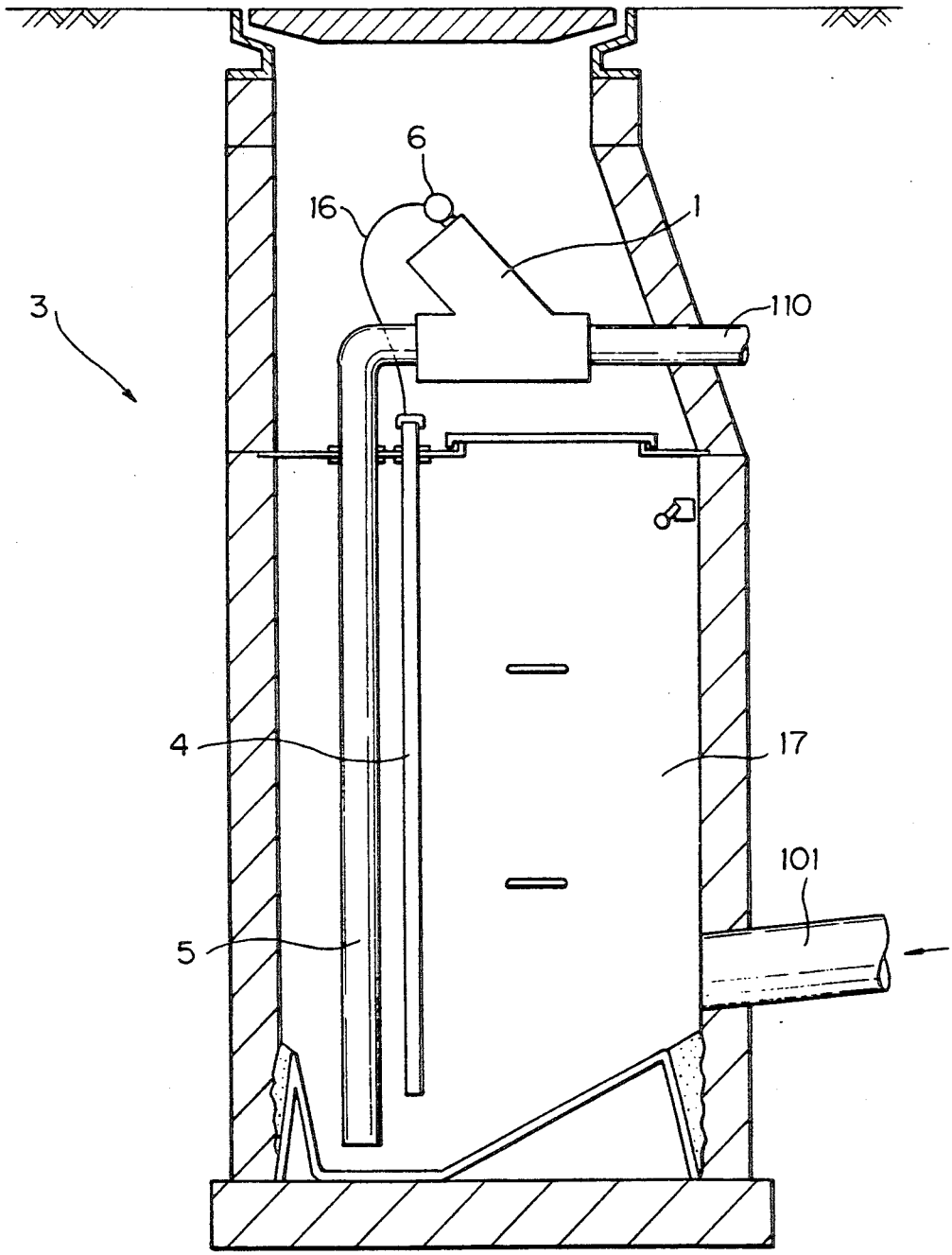
Fig.4 PRIOR ART
FIG. 4 is a sectional view of a sewage reservoir having a vacuum valve therein.

FIG. 2 shows a controller for properly controlling opening/closing operations of a vacuum valve, employable in a vacuum type sewage collecting system, in accordance with a second embodiment of the present invention. The same components as those in the first embodiment are represented by the same reference numerals.

Figure 5:
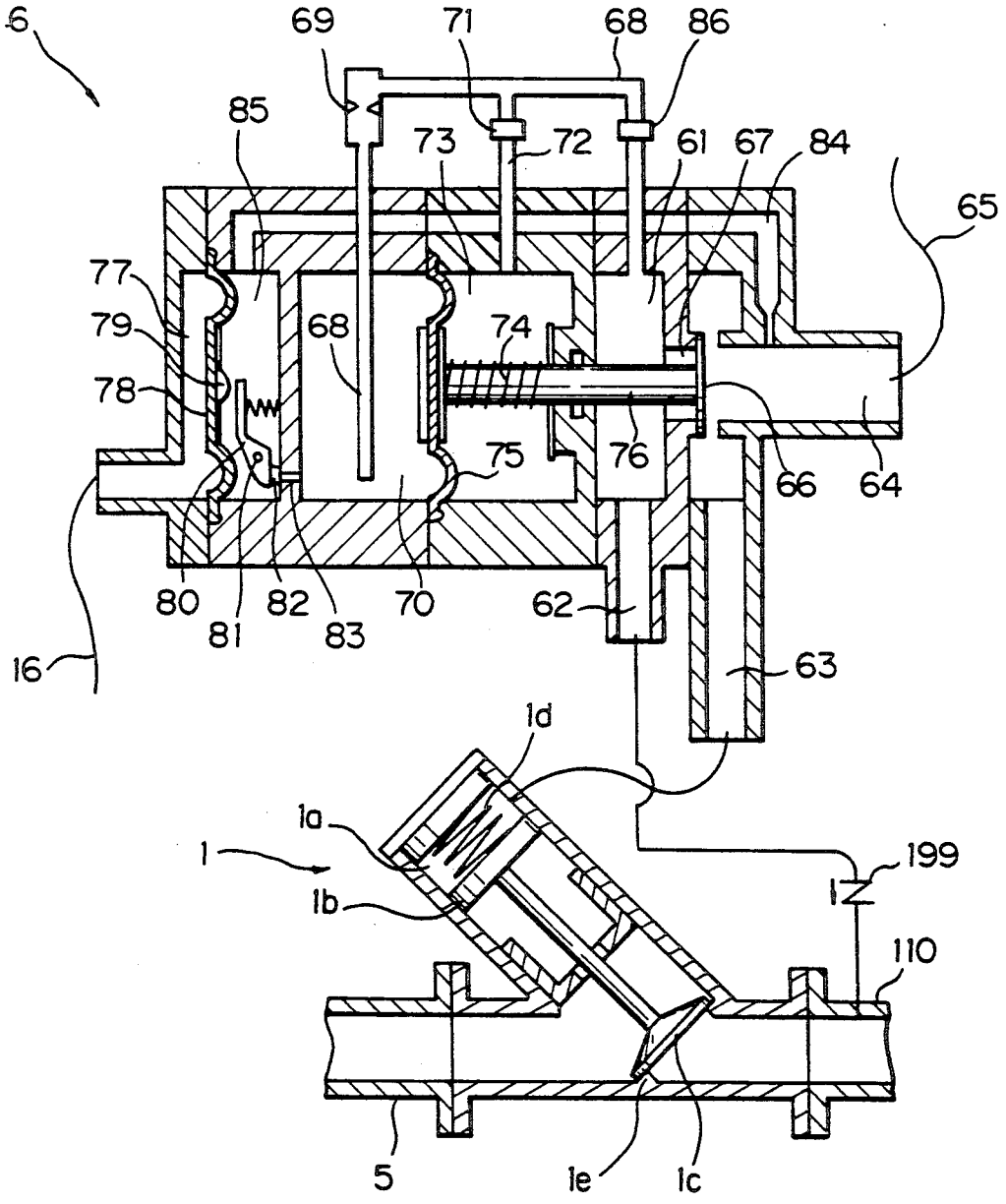
FIG. 5 is a schematic sectional view of a conventional controller for controlling opening/closing operations of a vacuum valve.

As is apparent from the drawing, in contrast with the conventional vacuum controller 6 shown in FIG. 5, a vacuum valve controller 6 of the present invention comprises an opening/closing valve 98 connected to a first vacuum chamber 70 via piping 96, and a closed type air tank 97 connected to the valve 98 via piping 55.

In the drawing, reference numeral 54 designates piping by way of which a negative pressure in the vacuum sewage pipe 110 is introduced into a chamber 98*b* of the valve 98. In addition, reference numeral 99 designates an orifice.

First, a case where a high negative pressure prevails throughout the vacuum sewage pipe 110 will be described.

In the illustrated case, i.e. in a case where the vacuum valve 1 is kept closed, the pressure in the first vacuum chamber 70 and the pressure in a second vacuum chamber 73 are both negative.

Since the vacuum sewage pipe 110 has a high negative pressure at this time, the negative pressure which has been introduced into the chamber 98*b* of the valve 98 via the piping 54 overcomes the resilient force of a coil spring 51 which normally acts in the direction of opening a valve disc 50 in the valve 98 (in the upward direction as viewed in the drawing), whereby a diaphragm 52 is displaced downwardly so as to cause the valve disc 50 to close a valve hole 53.

Thus, when a valve port 83 is closed after the pressure in the first vacuum chamber 70 becomes atmospheric and the vacuum valve 1 is opened, air in the first vacuum chamber 70 is displaced into the second vacuum chamber 73 and a distributing chamber 61. However, a volume of air to be displaced is limited only to a sum of a volume of air in the first vacuum chamber 70 and a volume of air in a smaller chamber 98*a* of the valve 98.

When the differential pressure between the first vacuum chamber 70 and the second vacuum chamber 73 is reduced below a predetermined value, a valve 66 is displaced in the leftward direction to close a valve port 67, whereby the vacuum valve 1 is closed.

Next, a case where a low negative pressure prevails throughout the vacuum sewage pipe 110 will be described.

As long as the vacuum valve 1 is kept closed, the negative pressure in the first chamber 70 is kept equal to the negative pressure in the second vacuum chamber 73 owing to piping 62.

Since the vacuum sewage pipe 110 has a low negative pressure at this time, the valve closing force exerted on the valve disc 50 might not overcome the resilient force of the coil spring 51, depending on the magnitude of the negative pressure which has been introduced into the chamber 98*b* of the valve 98 via the orifice 99 and the piping 54, whereby the diaphragm 52 could be raised upwardly so that the valve disc 50 opens the valve hole 53.

Thus, when the pressure in the first vacuum chamber 70 is raised to atmospheric pressure to open the vacuum valve 1, the pressure in the tank 97 is also raised to an atmospheric pressure.

Thereafter, when the valve port 83 is closed, not only air in the first vacuum chamber 70 but also air in the tank 97 is displaced to the second vacuum chamber 73 and the distributing chamber 61. Consequently, an ample volume of air having an atmospheric pressure is displaced in the above-described manner.

Therefore, in this case, a longer period of time is required for the volume of air to be displaced, until the differential air pressure between the second vacuum chamber 73 and the first vacuum chamber 70 is reduced below a predetermined value. Thus, the period of time that elapses before the vacuum valve 1 is closed can be lengthened to the same extent as in the case where the vacuum sewage pipe 110 has a high negative pressure.

According to the present invention, the needle valves 69 and 88 are used as fluid flow resisting means in the first and second embodiments. Alternatively, another fluid flow resisting means in the form of an orifice or the like may be employed.

As is apparent from the above description, according to the present invention, the same period of time that elapses before the vacuum valve is closed when a high negative pressure prevails throughout the vacuum sewage pipe will be maintained no matter how low of a negative pressure prevails throughout the vacuum sewage tube. As a result, a required volume of air can be introduced into the vacuum sewage pipe. Additionally, air locks induced by sewage in the vacuum sewage pipe can be prevented.

While the present invention has been described above with respect to two preferred embodiments thereof, it should of course be understood that the present invention should not be limited only to these embodiments but various changes or modifications may be made without departure from the scope of the invention as defined by the appended claims.

What is claimed is:

1. A vacuum type sewage collecting system for collecting sewage from a plurality of facilities, said system comprising: a sewage reservoir for storing the sewage from the facilities; a vacuum valve and a vacuum sewage pipe, the interior of which pipe is held at a negative pressure, connected to said sewage reservoir for delivering the sewage from the reservoir; detecting means for detecting the quantity of the sewage stored in said reservoir, and a controller for controlling opening/closing operations of said vacuum valve, said controller including a first vacuum chamber, a second vacuum chamber, first piping connecting said first vacuum chamber and said second vacuum chamber to said vacuum sewage pipe, fluid flow resisting means disposed in said first piping for offering resistance against the flow of fluid through said first piping, atmospheric pressure introducing means for introducing an atmospheric pressure into said first vacuum chamber when the quantity of the sewage stored in said sewage reservoir that is detected by said detecting means exceeds a predetermined value, shifting means for selectively introducing the negative pressure from said sewage pipe to said vacuum valve to open or close the vacuum valve depending on the differential pressure existing between the first vacuum chamber and the second vacuum chamber, at least one pipe having a second fluid flow resisting means disposed therein for offering resistance against the flow of fluid in said one pipe, said one pipe being connected to said first piping in a parallel relationship therewith, and opening/closing valve means operatively connected in said one pipe for closing said one pipe when the negative pressure in the vacuum sewage pipe is lower than a predetermined value.

2. A vacuum type sewage collecting system for collecting sewage from a plurality of facilities, said system comprising: a sewage reservoir for storing the sewage from the facilities; a vacuum valve and a vacuum sewage pipe, the interior of which pipe is held at a negative pressure, connected to said sewage reservoir for delivering the sewage from the reservoir; detecting means for detecting the quantity of the sewage stored in said reservoir; and a controller for controlling opening/closing operations of said vacuum valve, said controller including a first vacuum chamber, a second vacuum chamber, first piping connecting said first vacuum chamber and said second vacuum chamber to said vacuum sewage pipe, fluid flow resisting means disposed in said first piping for offering resistance against the flow of fluid through said first piping, atmospheric pressure introducing means for introducing an atmospheric pressure into said first vacuum chamber when the quantity of the sewage stored in said sewage reservoir that is detected by said detecting means exceeds a predetermined value, shifting means for selectively introducing the negative pressure from said sewage pipe to said vacuum valve to open or close the vacuum valve depending on the differential pressure existing between the first vacuum chamber and the second vacuum chamber, a closed type air tank having a predetermined capacity, and opening/closing valve means, connecting said air tank to said first vacuum chamber, for interrupting communication between said first vacuum chamber and said air tank when the negative pressure in the vacuum sewage pipe is higher than a predetermined negative pressure value and for establishing communication between said first vacuum chamber and said air tank when the negative pressure in the vacuum sewage pipe is lower than said predetermined negative pressure value.

3. A controller for properly controlling opening/-closing operations of a vacuum valve employable in a vacuum type sewage collecting system, said controller comprising: a first vacuum chamber, a second vacuum chamber, first piping connecting said first vacuum chamber and said second vacuum chamber, fluid flow resisting means disposed in said first piping for offering resistance against the flow of fluid through said first piping, atmospheric pressure introducing means for introducing an atmospheric pressure into said first vacuum chamber when a pressure indication issued thereto exceeds a predetermined value, negative pressure outlet piping through which negative pressure introduced to the controller can issue therefrom, shifting means for selectively opening said negative pressure outlet piping depending on the differential pressure existing between the first vacuum chamber and the second vacuum chamber, at least one pipe having a second fluid flow resisting means disposed therein for offering resistance against the flow of fluid in said one pipe, said one pipe being connected to said first piping in a parallel relationship therewith, and opening/closing valve means operatively connected in said one pipe for closing said one pipe when the negative pressure introduced thereto is lower than a predetermined value.

4. A controller for properly controlling opening/-closing operations of a vacuum valve employable in a vacuum type sewage collecting system, said controller comprising: a first vacuum chamber, a second vacuum chamber, first piping connecting said first vacuum chamber and said second vacuum chamber, fluid flow resisting means disposed in said first piping for offering resistance against the flow of fluid through said first piping, atmospheric pressure introducing means for introducing an atmospheric pressure into said first vacuum chamber when a pressure indication issued thereto exceeds a predetermined value, negative pressure outlet piping through which negative pressure introduced to the controller can issue therefrom, shifting means for selectively opening said negative pressure outlet piping depending on the differential pressure existing between the first vacuum chamber and the second vacuum chamber, a closed type air tank having a predetermined capacity, and an opening/closing valve means, connecting said air tank to said first vacuum chamber, for interrupting communication between said first vacuum chamber and said air tank when the negative pressure introduced to the valve means is higher than a predetermined negative pressure value and for establishing communication between said first vacuum chamber and said air tank when the negative pressure introduced thereto is lower than said predetermined negative pressure value.

* * * * *